United States Patent [19]

Rowland

[11] 4,168,063

[45] Sep. 18, 1979

[54] INFLATABLE ATHLETIC WRIST MOVEMENT RESTRAINT

[76] Inventor: George D. Rowland, 5440 Fillmore St., Hollywood, Fla. 33021

[21] Appl. No.: 897,729

[22] Filed: Apr. 19, 1978

[51] Int. Cl.[2] ..... A63B 69/00

[52] U.S. Cl. ..... 273/54 B; 128/DIG. 20

[58] Field of Search ..... 273/54 B, 189 A; 2/161 A; 128/77, 87 R, 89 R, DIG. 20

[56] References Cited

U.S. PATENT DOCUMENTS

| | | | |
|---|---|---|---|
| 3,217,332 | 11/1965 | Gross | 273/54 B |
| 3,581,740 | 6/1971 | Sherbourne | 128/77 |
| 3,779,550 | 12/1973 | Benoun et al. | 273/54 B |

*Primary Examiner*—Anton O. Oechsle

*Attorney, Agent, or Firm*—Barry L. Haley; Eugene F. Malin

[57] ABSTRACT

An athletic device for restraining hand movement about the wrist which allows for variably increasing or decreasing the relative stiffness of the restraining member that is adjustably coupled to the back and side of the hand and wrist. The device is used to prevent wrist "break" or undesired hand movement during the delivery of a bowling ball. The device includes a plurality of wrist and hand embracing straps coupled to an L-shaped housing that encloses a removeable, inflatable restraint chamber that is sized to reach from the first knuckle longitudinally past the wrist. The housing includes finger engaging loops. The firmness and individual comfort of the restraint may be adjusted by controlling the volume of air (air pressure) within the support member.

2 Claims, 5 Drawing Figures

INFLATABLE ATHLETIC WRIST MOVEMENT RESTRAINT

BACKGROUND OF THE INVENTION

This invention relates to an athletic device which is used to regulate and resist hand/wrist relative movement while bowling or the like. Specifically, the device provides a glove-like athletic device attached to the hand and wrist which includes a pneumatic chamber having a plurality of longitudinally disposed tubes used to firmly but comfortably hold the hand and knuckles in a fixed position relative to the wrist.

The prior art shows a plethora of devices utilized in athletic events for various restrictions or restraints worn on portions of the body. A patent issued to Benoun, et al, U.S. Pat. No. 3,779,550, issued Dec. 18, 1973, shows a wrist brace having a plurality of straps with a rigid portion which extends along the wrist to prevent breaking of the wrist while bowling. One of the deficiencies of the Benoun device is that the rigidity of the brace is fixed and is not adjustable in stiffness. The result is that a bowler can experience discomfort when using such a device which in itself can act to reduce the effectiveness of the arm and wrist action while bowling. The present invention allows a bowler or other athlete to adjust the amount of stiffness to obtain the most desirable and yet comfortable restraint action necessary to resist wrist breaking and undesired hand movement.

BRIEF DESCRIPTION OF THE INVENTION

A wrist/hand relative motion restrainer for use by bowlers or the like to prevent or restrict in a controlled manner the amount of wrist/hand relative movement comprising a flexible housing, an inflatable chamber removeably disposed in said housing, a plurality of wrist and hand engaging adjustable straps connected to said housing, and a valve coupled to said chamber for introducing or removing air from said restraint chamber. The housing includes an L-shaped body that extends from the first knuckles of the hand to below the wrist. A plurality of finger receiving loops are likewise coupled to one end of the housing and are used in conjunction with the straps to firmly hold the restraint chamber to the back of the hand and wrist of the wearer. The device, when in position, allows freedom of the fingers to grasp a bowling ball or the like while providing resistance or restraint which prevents the hand from moving relative to the longitudinal axis of the forearm at the wrist (which is termed "breaking of the wrist"), thus keeping a relatively straight planar surface between the first knuckles of the finger to a position approximately above the wrist (toward the forearm). With the pneumatic chamber, the resisting force is adjustable for the comfort of the wearer such so that the wearer may experience the most advantageous position of the device to allow for some slight movement of the hand at the wrist. Because of the L-shaped portion wrapped around the lower hand exterior, erratic hand movement during bowling ball delivery is prevented.

The pneumatic chamber may be composed of a plurality of tubes, the longitudinal directional axes being that in the direction of the longitudinal axis of the forearm. These tubes are joined together in a side-by-side array. The amount of air pressure in the tubes can be varied which allows for greater or lesser movement of the device.

It is an object of this invention to provide an improved athletic device which restrains relative movement between the forearm and the hand at the wrist during bowling or the like.

It is another object of this invention to provide a hand-held guide which prevents the dropping and lowering of the hand towards the little finger while engaged in delivery of a bowling ball or the like.

And yet still another object of this invention is to prevent erratic hand rotation during bowling or the like which is achieved by the instant invention.

And still yet another object of this invention is to provide a hand/wrist movement restraint that is adjustable as to its restraining force using a pneumatic chamber.

In accordance with these and other objects which be apparent hereinafter, the instant invention will now be described with particular reference to the accompanying drawings.

PREFERRED EMBODIMENT OF THE INVENTION

Figure 1:
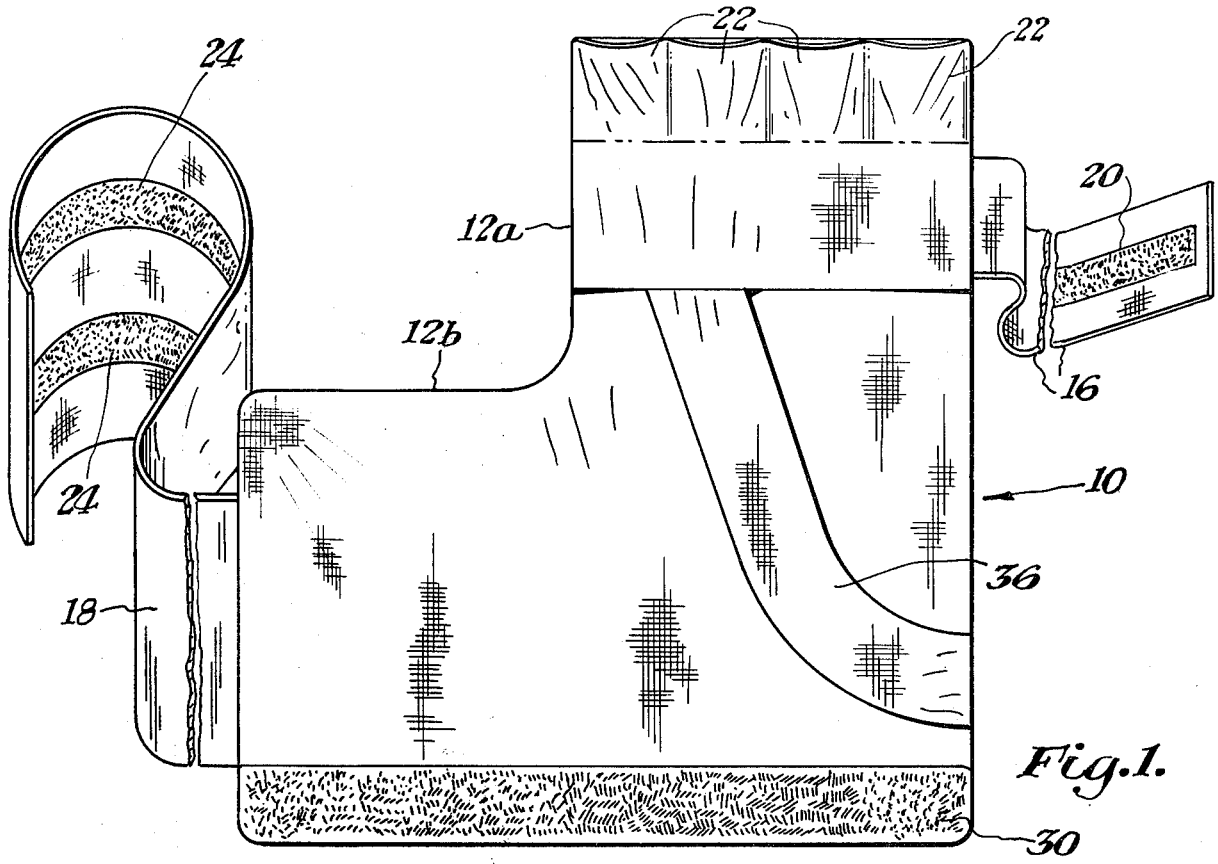
FIG. 1 shows a front elevational view of the instant invention.

Referring now to the drawings, and specfically FIG. 1, the instant invention is shown generally at 10 comprising a flexible housing 12 which may be comprised of a fabric having an upper portion 12A with finger receiving loops 22 connected thereto and a palm engaging strap 36 and straps 16 and 18 having fasteners 20 and 24 respectively connected thereto. The housing includes a VELCRO flap 30 shown open which allows access to the inner portion of the housing for reasons which are described below. As shown in FIG. 1, the back of the hand of the user would rest against the face 12 shown of the housing with the thumb projecting toward strap 16 while straps 16 and 18 would be wrapped around the hand and the other side of the device. The bottom portion of the housing 12B is greater in width than the upper portion of the housing 12A which is sized to approximate the width of an operator's hand.

Figure 2:
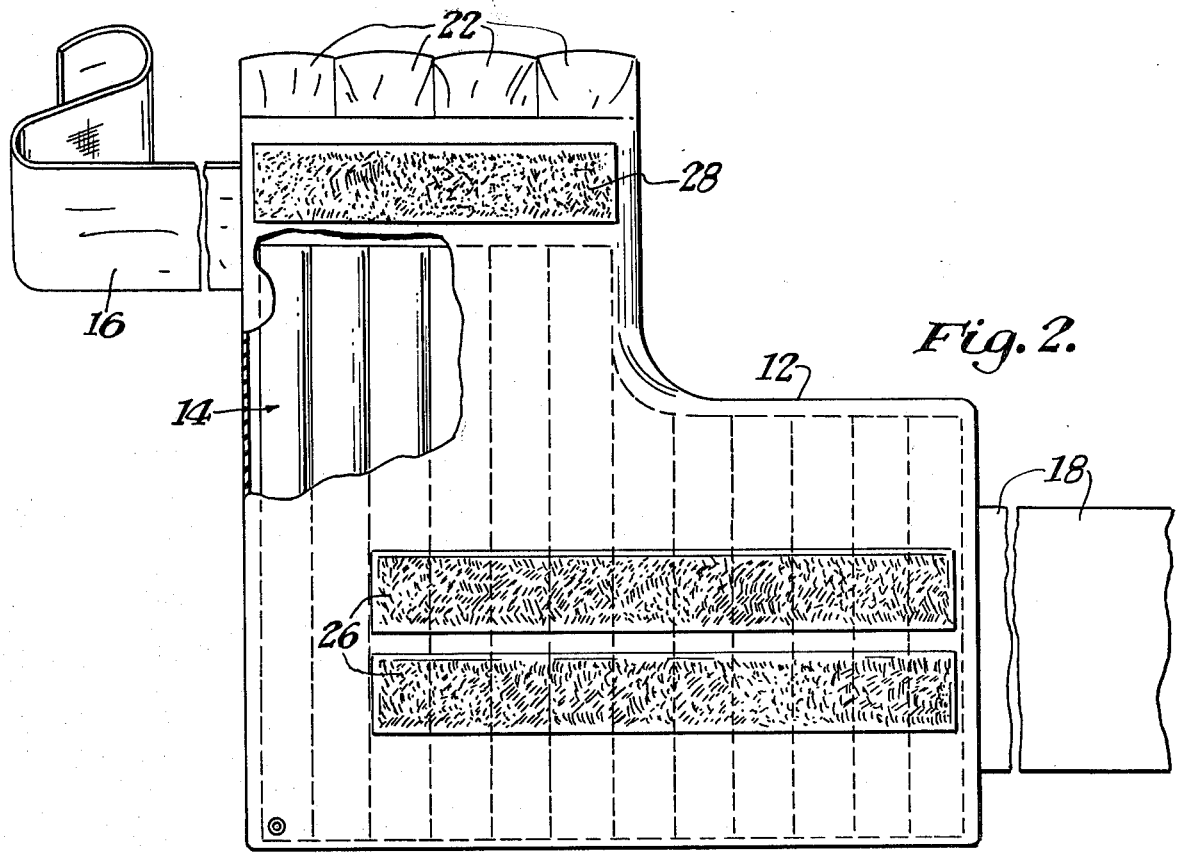
FIG. 2 shows a back elevational view of the instant invention partially cut away.

Referring now to FIG. 2, the opposite side of Applicant's device is shown having connected to the flexible housing 12 an upper VELCRO fastener 28 and lower fasteners 26. The strap 16 thus can be adjustably affixed to the housing 12 via fasteners 20 (FIG. 1) and 28 to fasten the hand to the housing. The lower strap 18 is adjustable about the hand by fasteners 24 (FIG. 1) and fasteners 26 by wrapping strap 18 around the wrist to firmly hold the housing along the back of the hand and wrist and with the lower portion 12A encompassing the side and front portion of the hand disposed below the baby finger of the wearer. The back of the hand engages the surface shown in FIG. 1.

Figure 3:
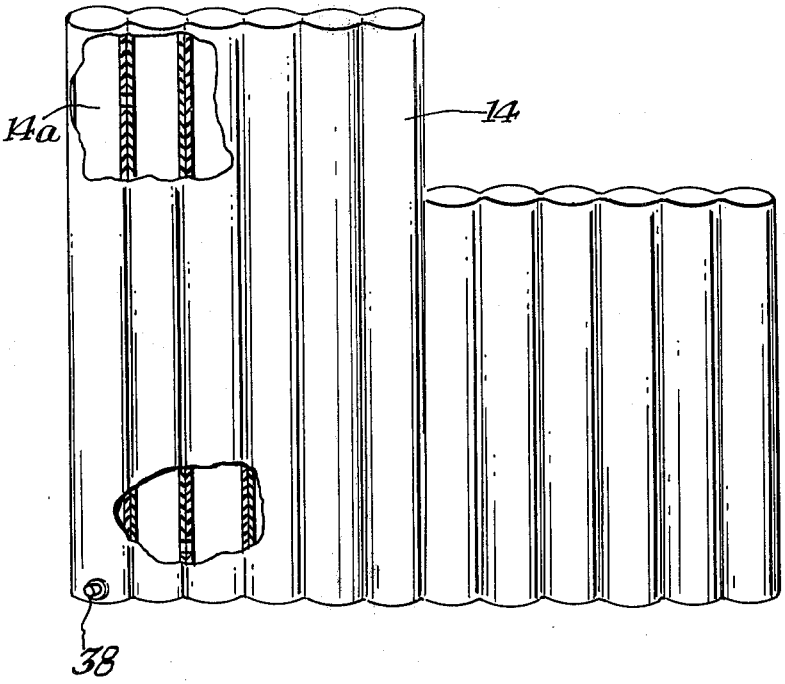
FIG. 3 shows a perspective view of the pneumatic chamber utilized in the instant invention.

FIG. 3 shows the pneumatic restraint chamber 14 removed from the housing which is comprised of a plurality of elongated tubes connected in a side-by-side array, the entire pneumatic restraint formed in an L-shape to fit snugly within the housing 12. The longitudinal axis of each tube is disposed such that when inserted in the housing each is parallel to the longitudinal axes of the fingers and forearm. The tubular array provides sufficient restraint necessary for the utilization of the device. Each tube is connected in fluid communication with adjacent tubes such that the entire device is inflatable through valve 38.

Figure 4:
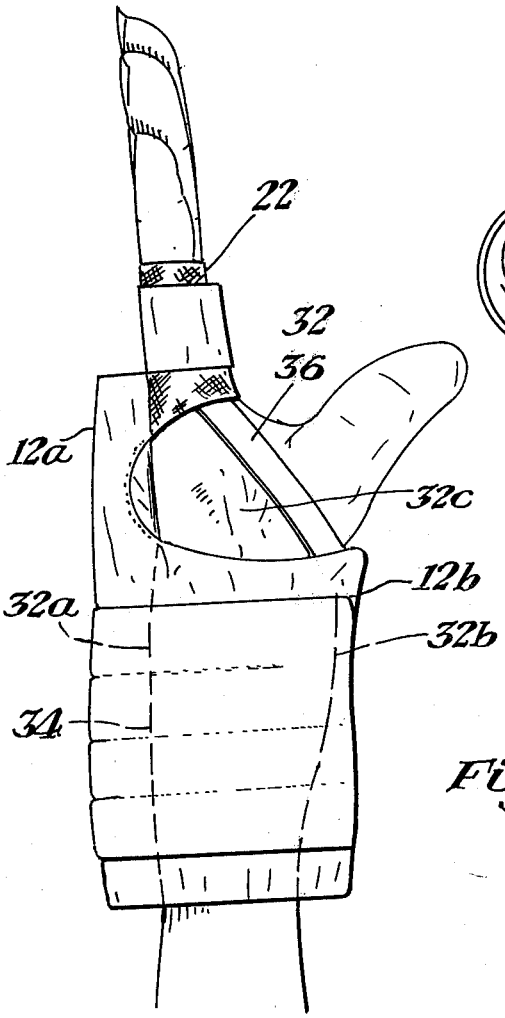
FIG. 4 is a side elevational view of the instant invention as affixed to the hand of an operator.

FIG. 4 shows the device affixed to a hand, viewed from the baby finger side of the hand. The back of the hand 32A and wrist area 34 are restrained by the pneumatic chamber in housing 12 to prevent the hand movement at the wrist backward into a normally perpendicular relationship between the forearm and the hand, commonly referred to as "breaking of the wrist". The hand edge 32C and palm 32B are braced by the device which prevents the tendency of movement in the plane of the fingers dropping downward relative to the arm. Rotational movement relative to the hand is likewise prevented by wrapping one side of the hand with the restraint body.

Figure 5:
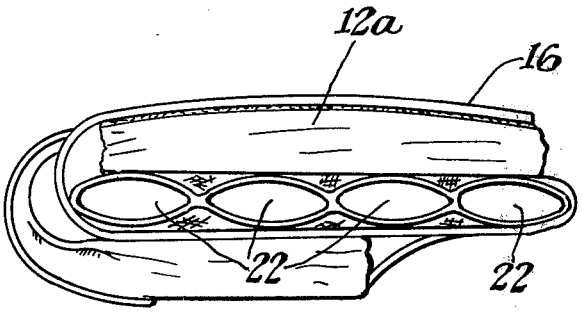
FIG. 5 is a top plan view of the instant invention.

FIG. 5 shows the finger receiving loops 22.

Referring back to FIG. 3, the pneumatic restraint chamber 14 includes a valve 38 which allows air to be introduced to inflate the restraint or to let air escape in order to reduce the pressure in the restraint. This allows the device to be adjusted by the wearer as to the amount of inflation pressure which will directly affect the amount of restraint provided by the device and the comfort of the fit on a particular wearer whose specific hand, wrist size and shape characteristics may vary. A user can determine by varying different pressures a particular pressure in the inflatable restraint that is best adapted to provide the most effective results in preventing the backward movement of the hand during the bowling delivery and lateral and rotational movements of the hand and wrist to provide a more effective ball delivery. The tube axes run longitudinal relative to the hand and wrist to provide additional restraint. Each tube is in fluid communication with valve 38. The pneumatic chamber 14 is removable from housing 12 (FIG. L) when flap 30 is in the open position.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An athletic glove for preventing movement between the hand and the forearm while bowling or the like which prevents and restrains "breaking of the wrist" comprising:

an L-shaped flexible housing;

a plurality of finger receiving loops connected to the upper portion of said housing;

an adjustable strap connected to the upper portion of said L-shaped housing;

first and second fastening means connected to said strap and said upper portion of said housing for providing an adjustable connection to the upper portion of the housing;

an L-shaped pneumatic chamber mounted within said flexible housing;

a second strap connected to the lower part of said L-shaped housing;

third and fourth fastening means connected to said strap and said housing for adjustably connecting said lower strap to said housing;

said L-shaped housing lower portion being sized to cover the back side portion of a hand inserted in the finger receiving loops.

2. An athletic glove, as in claim 1, wherein:

said pneumatic chamber includes a plurality of elongated tubes connected in a side-by-side array, each of said tubes being in fluid communication with each other; and a valve coupled to said chamber for inflating or deflating said chamber.

* * * * *